US012007151B2

(12) United States Patent
Fang et al.

(10) Patent No.: US 12,007,151 B2
(45) Date of Patent: Jun. 11, 2024

(54) REFRIGERATOR AND METHOD AND DEVICE FOR CONTROLLING REFRIGERATION THEREOF

(71) Applicants: HEFEI MIDEA REFRIGERATOR CO., LTD., Anhui (CN); HEFEI HUALING CO., LTD., Anhui (CN); MIDEA GROUP CO., LTD., Guangdong (CN)

(72) Inventors: Ruiming Fang, Anhui (CN); Yu Li, Anhui (CN)

(73) Assignees: HEFEI MIDEA REFRIGERATOR CO., LTD., Anhui (CN); HEFEI HUALING CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 423 days.

(21) Appl. No.: 17/420,996

(22) PCT Filed: Jan. 9, 2019

(86) PCT No.: PCT/CN2019/070989
§ 371 (c)(1),
(2) Date: Jul. 6, 2021

(87) PCT Pub. No.: WO2020/142930
PCT Pub. Date: Jul. 16, 2020

(65) Prior Publication Data
US 2022/0082314 A1 Mar. 17, 2022

(51) Int. Cl.
*F25B 49/02* (2006.01)
*F25C 1/00* (2006.01)

(52) U.S. Cl.
CPC ..... *F25B 49/02* (2013.01); *F25C 1/00* (2013.01); *F25B 2700/2104* (2013.01);
(Continued)

(58) Field of Classification Search
CPC .... F25B 49/02; F25B 2700/2104; F25C 1/00; F25C 1/24; F25C 2400/10; F25C 2600/02; F25C 2600/04
See application file for complete search history.

(56) References Cited

U.S. PATENT DOCUMENTS 7,681,406 B2 3/2010 Cushman et al.
8,484,987 B2 7/2013 Ducharme et al.
(Continued)

FOREIGN PATENT DOCUMENTS

CA 2532390 A1 7/2007
CN 100374799 C 3/2008
(Continued)

OTHER PUBLICATIONS

English translation of Kurihara et al. (JP-2000292046-A). (Year: 2000).*

*Primary Examiner* — Miguel A Diaz
(74) *Attorney, Agent, or Firm* — Seed IP Law Group LLP

(57) ABSTRACT

Disclosed are a refrigerator and a method and device for controlling refrigeration of the refrigerator. A refrigeration system of the refrigerator includes an evaporator configured to refrigerate a refrigerating compartment and make ice in an ice machine, an ice-making damper and a refrigerating damper. The method includes recognizing a current ice-making stage of the ice machine, acquiring a current temperature of an ice-making compartment in the refrigerator, and controlling opening and closing of the ice-making damper and the refrigerating damper according to the current ice-making stage and the current temperature. Through controlling the refrigeration period of the refrigerating compartment and delaying the refrigeration starting time of the refrigerating compartment, the refrigeration cycle of the refrigerating compartment matches the ice-making cycle of the ice-making compartment, thus improving the ice-making
(Continued)

efficiency of the ice machine and the ice-making amount, shortening the ice-making cycle, and reducing the energy consumption of the refrigerator.

18 Claims, 6 Drawing Sheets

(52) U.S. Cl.
CPC ..... *F25C 2400/10* (2013.01); *F25C 2600/02* (2013.01); *F25C 2600/04* (2013.01)

(56) References Cited

U.S. PATENT DOCUMENTS

| | | | | |
|---|---|---|---|---|
| 2008/0072610 | A1 | 3/2008 | Venkatakrishnan et al. | |
| 2008/0190125 | A1 | 8/2008 | Yoshioka et al. | |
| 2013/0025303 | A1 | 1/2013 | Yoon et al. | |
| 2018/0283758 | A1 | 10/2018 | Ding et al. | |
| 2018/0328642 | A1 | 11/2018 | McCollough et al. | |
| 2021/0148627 | A1* | 5/2021 | Jeong | F25C 5/22 |

FOREIGN PATENT DOCUMENTS

| | | | | |
|---|---|---|---|---|
| CN | 102213521 | A | 10/2011 | |
| CN | 102395843 | A | 3/2012 | |
| CN | 106642859 | A | 5/2017 | |
| CN | 106885419 | A | 6/2017 | |
| CN | 106918173 | A | 7/2017 | |
| CN | 107062755 | A | 8/2017 | |
| CN | 107314600 | A | 11/2017 | |
| CN | 108679900 | A | 10/2018 | |
| EP | 2401564 | A2 | 1/2012 | |
| EP | 2413071 | A2 * | 2/2012 | F25C 5/22 |
| JP | H08261627 | A | 10/1996 | |
| JP | 2000292046 | A * | 10/2000 | |
| JP | 2000292046 | A | 10/2000 | |
| JP | 2001221555 | A | 8/2001 | |
| JP | 2002022336 | A | 1/2002 | |
| JP | 3545617 | B2 | 7/2004 | |
| JP | 2006-132820 | A | 5/2006 | |
| KR | 10-2011-0097013 | A | 8/2011 | |
| WO | WO 2010099439 | A2 | 9/2010 | |

* cited by examiner

REFRIGERATOR AND METHOD AND DEVICE FOR CONTROLLING REFRIGERATION THEREOF

BACKGROUND

Technical Field

This application relates to the technical field of household appliances, and in particular, to a refrigerator and a method and device for controlling refrigeration of the refrigerator.

Description of the Related Art

In the related art, for a refrigerator with an ice machine, there are no requirements for a refrigeration period of a refrigerating compartment and an ice-making period of the ice machine. That is, when the ice machine is in an ice-making state, the refrigerating compartment can request and perform refrigeration at any time. This often leads to low ice-making efficiency of the ice machine, and high energy consumption of the refrigerator.

BRIEF SUMMARY

This application aims to solve one of the technical problems in the related technology at least to a certain extent.

The present disclosure in some embodiments provides a method for controlling refrigeration of a refrigerator. The method for controlling refrigeration of a refrigerator is capable of controlling the refrigeration period of the refrigerating compartment, so that the refrigeration cycle of the refrigerating compartment matches the ice-making cycle of the ice machine, thus improving the ice-making efficiency of the ice machine and reducing the energy consumption of the refrigerator.

This present disclosure in some embodiments also provides a device for controlling refrigeration of a refrigerator and a refrigerator.

To solve the above problem, a first aspect of the present disclosure provides a method for controlling refrigeration of a refrigerator. In some embodiments, a refrigeration system of the refrigerator comprises an evaporator, an ice-making damper and a refrigerating damper. The evaporator is configured to refrigerate a refrigerating compartment and make an ice in an ice machine The method comprises:

- recognizing a current ice-making stage of the ice machine;
- acquiring a current temperature of an ice-making compartment in the refrigerator; and
- controlling opening and closing of the ice-making damper and the refrigerating damper according to the current ice-making stage and the current temperature.

According to the method for controlling refrigeration of a refrigerator in embodiments of the present disclosure, the opening and closing of the ice-making damper and the refrigerating damper are controlled to determine the time of performing refrigeration and the time of ending refrigeration for corresponding compartments, and thus controlling the refrigeration period of the refrigerating compartment, delaying the refrigeration starting time of the refrigerating compartment, and setting the refrigeration starting time of the refrigerating compartment to be within a heating-deicing stage of ice-making mode of the ice-making compartment, such that the refrigeration cycle of the refrigerating compartment matches the ice-making cycle of the ice-making compartment. Accordingly, the ice-making efficiency of the ice machine is improved and the energy consumption of the refrigerator is reduced.

In embodiments of the present disclosure, controlling opening and closing of the ice-making damper and the refrigerating damper according to the current ice-making stage and the current temperature comprises:

- detecting and determining that the current ice-making stage is a heating-deicing stage;
- detecting and determining that the current temperature is greater than a first preset temperature threshold; and
- controlling the refrigerating damper to open and controlling the ice-making damper to close.

In embodiments of the present disclosure, the method further comprises:

- detecting and determining that the current temperature is less than or equal to the first preset temperature threshold; and
- controlling both the ice-making damper and the refrigerating damper to close.

In embodiments of the present disclosure, detecting and determining that the current ice-making stage is a heating-deicing stage comprises:

- acquiring a current operating power of the refrigerator;
- detecting and determining that the current operating power is within a preset range; and
- determining that the current ice-making stage is the heating-deicing stage.

In embodiments of the present disclosure, the method further comprises:

- detecting and determining that the current ice-making stage is a first ice-making stage;
- detecting and determining that the current temperature is greater than a second preset temperature threshold; and
- controlling both the ice-making damper and the refrigerating damper to open.

In embodiments of the present disclosure, the method further comprises:

- detecting and determining that the current temperature is less than or equal to the second preset temperature threshold; and
- controlling the refrigerating damper to close.

In embodiments of the present disclosure, before controlling opening and closing of the ice-making damper and the refrigerating damper according to the current ice-making stage and the current temperature, the method further comprises:

- acquiring a refrigeration request instruction issued by at least one of the refrigerating compartment and the ice-making compartment In embodiments of the present disclosure, before recognizing a current ice-making stage of the ice machine, the method further comprises:

- detecting and determining that the ice machine is currently operating in an ice-making mode In embodiments of the present disclosure, the method further comprises:

- detecting and determining that the ice machine is currently operating in a non-ice making mode;
- detecting a refrigeration request instruction issued by at least one of the refrigerating compartment and the ice-making compartment; and
- controlling the opening and closing of the ice-making damper and the refrigerating damper according to the refrigeration request instruction detected and a source of the refrigeration request instruction.

The present disclosure in embodiments further provides an electronic device, comprising:

at least one memory;

a processor; and at least one program, wherein the at least one program is stored in the memory that when executed by the at least one processor, to implement the method for controlling refrigeration of a refrigerator as described in the embodiments of the first aspect of the present disclosure.

The present disclosure in embodiments still further provides a non-transitory computer-readable storage medium having stored therein computer programs that, when executed by a processor, causes the processor to perform the method for controlling refrigeration of a refrigerator as described in the embodiments of the first aspect of the present disclosure.

To solve the above problems, a second aspect of the present disclosure in embodiments provides a device for controlling refrigeration of a refrigerator, wherein a refrigeration system of the refrigerator comprises an evaporator, an ice-making damper and a refrigerating damper, wherein the evaporator is configured to refrigerate a refrigerating compartment and make an ice in an ice machine.

In some embodiments, the device comprises:

a recognizing module, configured to recognize a current ice-making stage of the ice machine;

an acquiring module, configured to acquire a current temperature of the ice-making compartment in the refrigerator; and a controlling module, configured to control opening and closing of the ice-making damper and the refrigerating damper according to the current ice-making stage and the current temperature.

According to the device for controlling refrigeration of a refrigerator in embodiments of the present disclosure, the opening and closing of the ice-making damper and the refrigerating damper are controlled to determine the time of performing refrigeration and the time of ending refrigeration for corresponding compartments, and thus controlling the refrigeration period of the refrigerating compartment, delaying the refrigeration starting time for the refrigerating compartment, and setting the refrigeration starting time for the refrigerating compartment to be within a heating-deicing stage of ice-making mode of the ice-making compartment, such that the refrigeration cycle of the refrigerating compartment matches the ice-making cycle of the ice-making compartment. As result, the ice-making efficiency of the ice machine is improved and the energy consumption of the refrigerator is reduced.

In embodiments of the present disclosure, the controlling module is further configured to:

detect and determine that the current ice-making stage is a heating-deicing stage;

detect and determine that the current temperature is greater than a first preset temperature threshold; and control the refrigerating damper to open and control the ice-making damper to close.

In embodiments of the present disclosure, the controlling module is further configured to:

detect and determine that the current temperature is less than or equal to the first preset temperature threshold; and control both the ice-making damper and the refrigerating damper to close.

In embodiments of the present disclosure, the controlling module is further configured to:

acquire a current operating power of the refrigerator;

detect and determine that the current operating power is within a preset range; and determine that the current ice-making stage is the heating-deicing stage.

In embodiments of the present disclosure, the controlling module is further configured to:

detect and determine that the current ice-making stage is a first ice-making stage;

detect and determine that the current temperature is greater than a second preset temperature threshold; and control both the ice-making damper and the refrigerating damper to open.

In embodiments of the present disclosure, the controlling module is further configured to:

detect and determine that the current temperature is less than or equal to the second preset temperature threshold; and control the refrigerating damper to close.

In embodiments of the present disclosure, the controlling module is further configured to:

acquire a refrigeration request instruction issued by at least one of the refrigerating compartment and the ice-making compartment.

In embodiments of the present disclosure, the controlling module is further configured to:

detect and determine that the ice machine is currently operating in an ice-making mode before recognizing a current ice-making stage of the ice machine.

In embodiments of the present disclosure, the controlling module is further configured to:

detect and determine that the ice machine is currently operating in a non-ice making mode;

detect a refrigeration request instruction issued by at least one of the refrigerating compartment and the ice-making compartment; and control the opening and closing of the ice-making damper and the refrigerating damper according to the refrigeration request instruction detected and a source of the refrigeration request instruction.

A third aspect of the present disclosure in embodiments provides a refrigerator, comprising the device for controlling refrigeration of a refrigerator, based on the device for controlling refrigeration of a refrigerator as described in embodiments of the above aspect. According to the device for controlling refrigeration of a refrigerator as described in embodiments of the above aspect, it is possible to implement the controlling of refrigeration period of the refrigerating compartment, such that the refrigeration cycle of the refrigerating compartment matches the ice-making cycle of the ice machine. As a result, the ice-making efficiency of the ice machine is improved and the energy consumption of the refrigerator is reduced.

DETAILED DESCRIPTION

Figure 1:
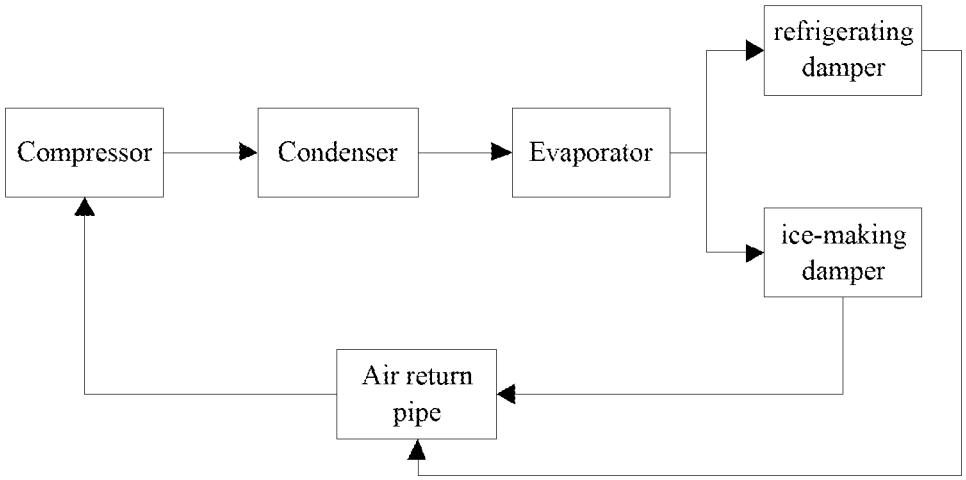
FIG. 1 is a block diagram of a refrigeration system that can be implemented in a method for controlling refrigeration of a refrigerator according to an embodiment of the present disclosure.

The embodiments of the present disclosure are described in detail below. Examples of the embodiments are shown in the accompanying drawings, in which the same or similar reference numerals indicate the same or similar elements or elements with the same or similar functions. The embodiments described below with reference to the drawings are exemplary and are intended to explain the present disclosure, which should not be understood as a limitation to the present disclosure.

A refrigerator and a method and device for controlling refrigeration of the refrigerator according to embodiments of the present disclosure are described below with reference to the drawings.

FIG. 1 is a block diagram of a refrigeration system that can be implemented in a method for controlling refrigeration of a refrigerator according to an embodiment of the present disclosure. As shown in FIG. 1, the refrigeration system includes at least a compressor, a condenser, an evaporator, an ice-making damper, a refrigerating damper, and an air return pipe. Among them, the compressor is connected to the condenser, the condenser is connected to the evaporator, the evaporator is respectively connected to the ice-making damper and the refrigerating damper, and the ice-making damper and the refrigerating damper are respectively connected to the compressor through the air return pipe. Among them, the evaporator is configured to refrigerate the refrigerating compartment in the refrigerator and make an ice in the ice machine. Among them, through controlling the opening and closing of the ice-making damper and the refrigerating damper, whether the ice-making compartment and the refrigerating compartment are refrigerated can be performed.

It should be noted that the ice machine in the embodiments of the present disclosure is located in a freezing compartment of the refrigerator.

Figure 2:
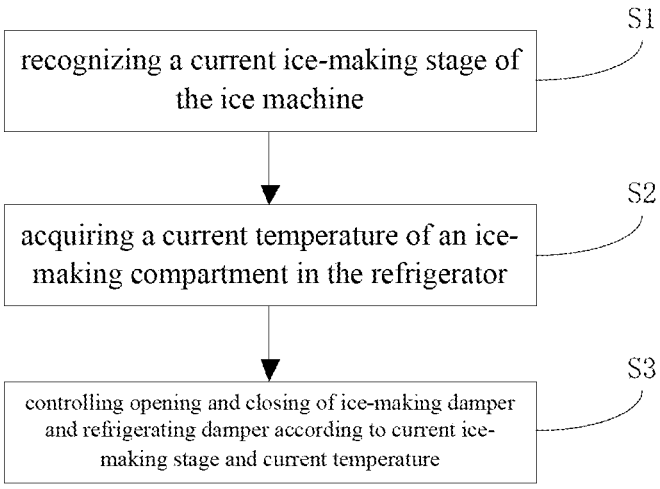
FIG. 2 is a schematic flow chart of a method for controlling refrigeration of a refrigerator according to an embodiment of the present disclosure.
Figure 3:
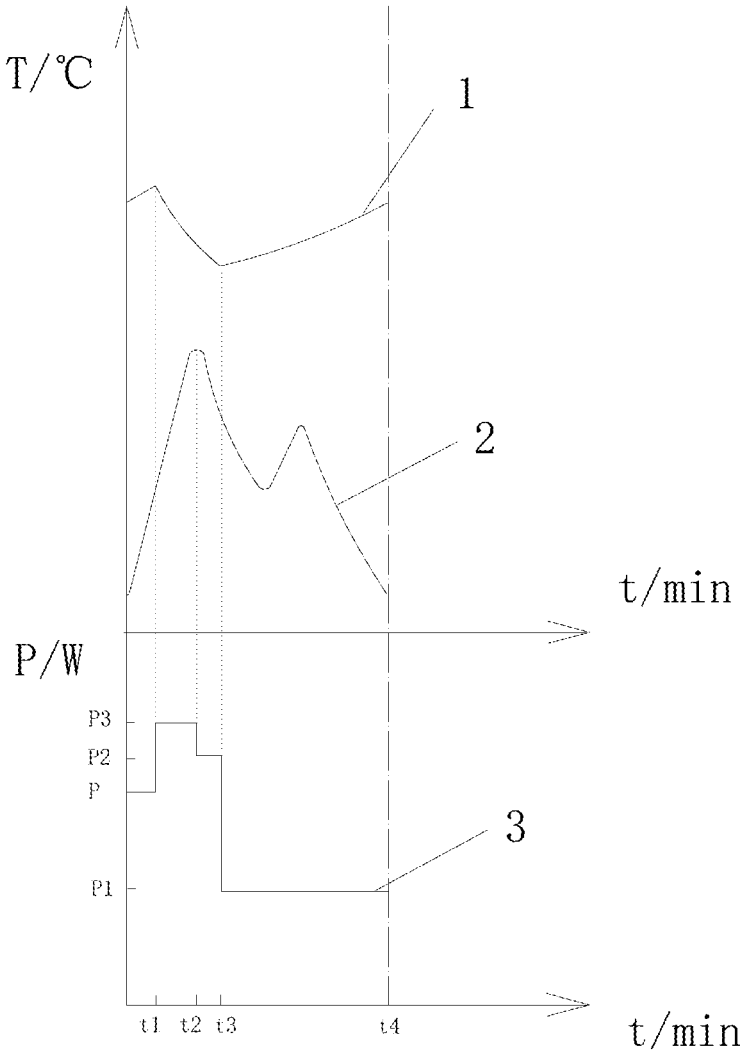
FIG. 3 is a schematic diagram showing a refrigeration cycle of a refrigerating compartment and an ice-making cycle of an ice-making compartment in a method for controlling refrigeration of a refrigerator according to an embodiment of the present disclosure.

FIG. 2 is a schematic flow chart of a method for controlling refrigeration of a refrigerator according to an embodiment of the present disclosure. As shown in FIG. 3, the method for controlling refrigeration of a refrigerator in this embodiment includes the following steps.

In S1, a current ice-making stage of the ice machine is recognized.

It should be noted that, in this embodiment, the ice-making stage of the ice machine includes two stages, i.e., a heating-deicing stage and a first ice-making stage. Among them, during the heating-deicing stage, a heating wire in the ice machine works to melt part of ice cubes, thereby causing the ice cubes to fall off. During the first ice-making stage, the ice-making evaporator works to decrease the temperature of the ice-making compartment, so that the liquid solidifies into a solid. It should be understood that the ice-making stage of the ice machine may be referred to as an ice-making mode, and the non-ice-making stage of the ice machine may be referred to as a non-ice-making mode to facilitate describing and distinguishing the ice-making stage and the non-ice-making stage.

Optionally, it is possible to detect and determine that the ice machine is currently operating in an ice-making mode, before recognizing the current ice-making stage of the ice machine. Specifically, when detecting whether the ice machine is operating in an ice-making mode, for example, a user's interactive interface or working mode selection button may be provided on the refrigerator, so that whether the ice machine is currently operating in an ice-making mode can be determined by user according to the user's interactive interface or working mode selection button on the refrigerator. If the user selects the ice-making mode through the user's interactive interface, it is determined that the ice machine is currently operating in an ice-making mode. Optionally, the working mode can be selected through voice or remote control. When the ice-making mode is selected through voice or remote control, it can be determined that the ice machine is currently operating in an ice-making mode.

During the heating-deicing stage in the ice-making mode, a heating wire in the ice machine need to work to increase the temperature, to cause the solidified ice cubes to fall off. Thus, the current operating power of the refrigerator would be greater than the normal operating power of the refrigerator under the action of heating wire. Thereby, in embodiments of the present disclosure, the current ice-making stage in the ice-making mode can be determined according to the current operating power of the refrigerator.

In the actual working process of the refrigerator, the operating power during the heating-deicing stage (hereinafter referred to as the "first power") is greater than the refrigerating power of the ice-making compartment alone in the refrigerator, but is less than the refrigerating power of both the ice-making compartment and the refrigerating compartment in the refrigerator (hereinafter referred to as the "second power"). Thus, during the heating-deicing stage, when the refrigerator simultaneously performs the refrigeration of refrigerating compartment, the operating power of the refrigerator (hereinafter referred to as the "third power" for convenience of description) would be greater than the second power due to the large power of heating wire in the ice machine. As shown in FIG. 3, line 1 shows the change of temperature in the refrigerating compartment with time, line 2 shows the change of temperature in the ice-making compartment with time, and line 3 shows the change of operating power of the refrigerator with time. Among them, in the time period from 0 to t1, the refrigerating compartment does not perform refrigeration but the ice-making mode is in the heating-deicing stage; in the time period from t1 to t2, the refrigerating compartment performs refrigeration and the ice-making mode is in the heating-deicing stage; in the time period from t2 to t3, the refrigerating compartment continues refrigeration but the ice-making mode turns to an ice-making stage; and in the time period from t3 to t4, the refrigerating compartment stops refrigeration and the ice-making mode keeps in the ice-making stage until the ice-making stage ends. In the entire ice-making mode, the operating power P during the heating-deicing stage is within the range of the first power P1 to the second power P2. Thus, whether the ice-making mode is in the heating-deicing stage can be determined according to the operating power of the refrigerator. If the ice-making mode is not in the heating-deicing stage, it is in a first ice-making stage.

Optionally, after the ice machine is determined to be operated in the ice-making mode, a current temperature of the heating wire in the ice machine can be detected, thereby determining the current temperature of the heating wire. If the current temperature of the heating wire is higher than the preset temperature, it indicates that the ice machine is currently in the heating-deicing stage of the ice-making mode.

In S2, a current temperature of an ice-making compartment in the refrigerator is acquired.

Specifically, a temperature sensor may be provided in the ice-making compartment in the refrigerator, to detect the current temperature of the ice-making compartment.

In S3, opening and closing of the ice-making damper and the refrigerating damper are controlled according to the current ice-making stage and the current temperature.

According to the current ice-making stage of the ice-making mode and the current temperature in the ice-making compartment acquired, the ice-making damper and the refrigerating damper can be controlled to determine whether the corresponding compartment is to be refrigerated. Further, the opening time of the refrigerating damper is controlled to control the refrigeration period of the refrigerating compartment, so that the refrigeration cycle of the refrigerating compartment can match the ice-making cycle of the ice-making compartment, and thus reducing the influence of the refrigeration in the refrigerating compartment on the ice-making in the ice machine, improving the ice-making efficiency and ice-making amount, shortening the ice-making cycle, and reducing the energy consumption of the refrigerator.

Figure 4:
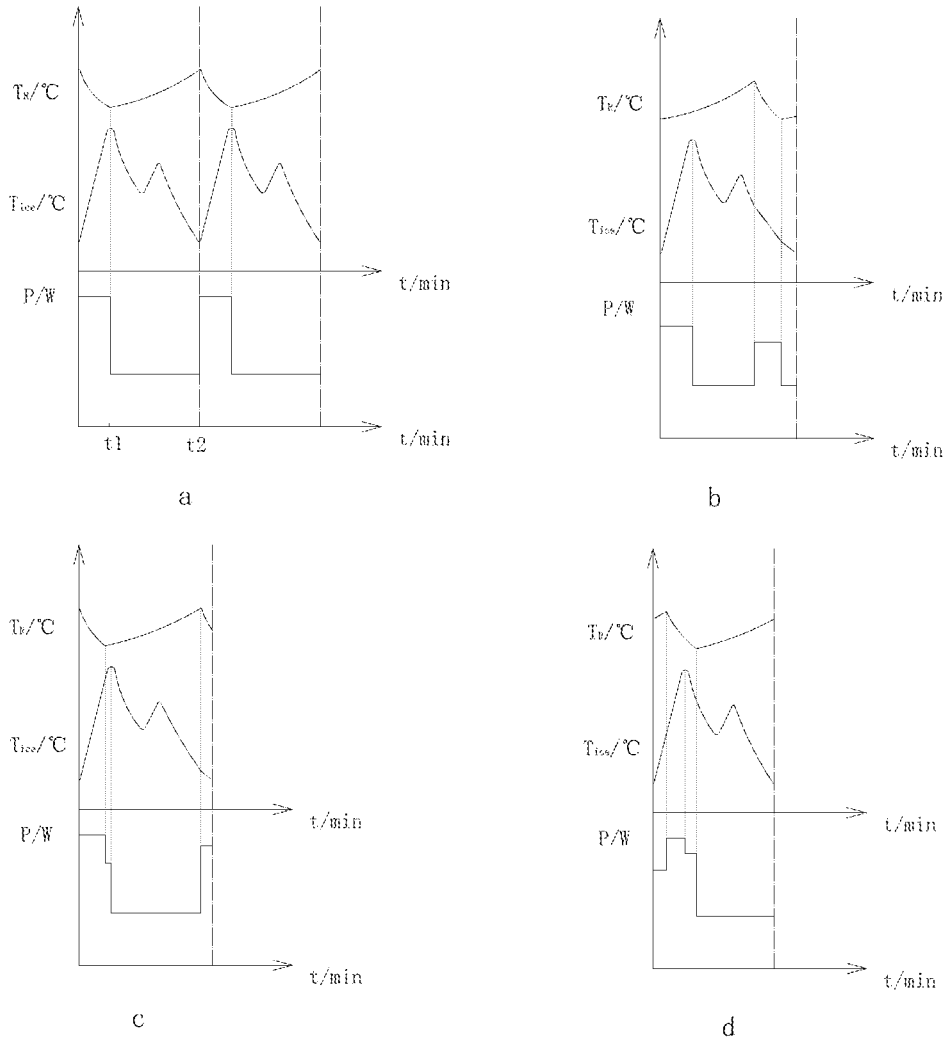
FIG. 4 is a schematic diagram of comparison of a refrigeration cycle of a refrigerating compartment and an ice-making cycle of an ice-making compartment in a method for controlling refrigeration of a refrigerator according to an embodiment of the present disclosure.

Referring to FIG. 4, it should be noted that, in an ideal state, as shown in FIG. 4*a*, the refrigeration cycle of the refrigerating compartment is same as the refrigeration cycle of the ice-making compartment. In this state, the ice-making efficiency of the ice machine is the highest, the ice-making amount is the largest and the energy consumption of the refrigerator is the lowest. Among them, during the time period from 0 to t1, the refrigerating compartment is in a refrigeration stage and the ice-making compartment is in a heating-deicing stage; during the time period from t1 to t2, the refrigerating compartment ends refrigerating, while the ice-making compartment starts into the first ice-making stage, and ice making begins. However, in practice, since the refrigeration cycle of the refrigerating compartment is often shorter than the ice-making cycle of the ice-making compartment, the situation shown in FIG. 4*b* often occurs during the operation of the refrigerator, thereby generally resulting in the refrigerating compartment being in a refrigeration stage and the ice-making compartment being in a first ice-making stage. In this case, due to the splitting of the amount of refrigerant, the temperature of the ice-making evaporator rises, despite still lower than the preset temperature, resulting in slow down of the decrease of temperature of the ice-making compartment, decreasing the ice-making rate, increasing the ice-making cycle, reducing the ice-making amount and increasing the energy consumption. In addition, even when the refrigeration starting time of the refrigerating compartment keeps path with the heating-deicing time of the ice-making compartment, the situation shown in FIG. 4*c* occurs. In this case, the ice-making compartment is still in the late stage of the heating-deicing stage when the refrigerating compartment begins a refrigeration stage again. Meanwhile, due to the splitting of the refrigerant, the temperature of the ice-making evaporator rises, despite still lower than the preset temperature, which would slow down the decrease of temperature of the ice-making compartment, decrease the ice-making rate, increase the ice-making cycle, reduce the ice-making amount, and increase the energy consumption. However, in the embodiments of the present disclosure, through controlling the refrigeration period of the refrigerating compartment and delaying the refrigeration time starting of the refrigerating compartment to be within a heating-deicing stage of ice-making mode of the ice-making compartment, the refrigeration cycle of the refrigerating compartment can match the ice-making cycle of the ice-making compartment, thereby forming the cycles as shown in FIG. 4*d*, thus greatly reducing the time period when both the refrigerating compartment and the ice-making compartment perform refrigerating. As a result, the influence of refrigeration in the refrigerating compartment on ice-making in the ice-making compartment is reduced, the ice-making efficiency and ice-making amount are improved, the ice-making cycle is shortened, and the energy consumption of the refrigerator is reduced.

Above all, the present disclosure in embodiments provides a method for controlling refrigeration of a refrigerator. The method controls the ice-making damper and the refrigerating damper in the refrigeration system of the refrigerator according to the current ice-making stage of the ice machine and the current temperature of the ice-making compartment. Through controlling the ice-making damper and the refrigerating damper, the time for performing refrigeration and the time for ending refrigeration for corresponding compartments are determined. Further, the refrigeration period of the refrigerating compartment is controlled, the refrigeration starting time of the refrigerating compartment is delayed, and the refrigeration starting time of the refrigerating compartment is set to be within a heating-deicing stage of ice-making mode of the ice-making compartment, such that the refrigeration cycle of the refrigerating compartment can match the ice-making cycle of the ice-making compartment, thus improving the ice-making efficiency of the ice machine and the ice-making amount, shortening the ice-making cycle, and reducing the energy consumption of the refrigerator.

Figure 5:
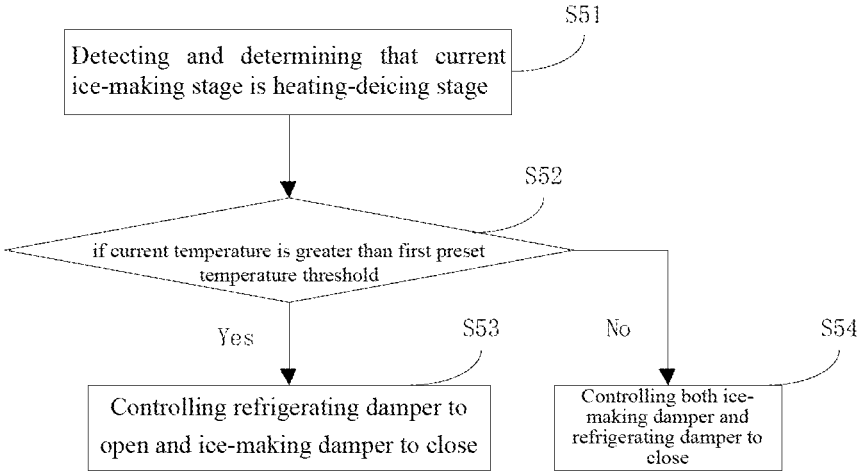
FIG. 5 is a schematic flow chart of a process for controlling a refrigeration starting time of a refrigerating compartment in a method for controlling refrigeration of a refrigerator according to an embodiment of the present disclosure.

In some embodiments, the time for performing refrigeration in the refrigerating compartment can be determined according to the temperature in the ice-making compartment. FIG. 5 is a schematic flow chart of a process for controlling a refrigeration starting time of the refrigerating compartment in the method for controlling refrigeration of a refrigerator according to an embodiment of the present disclosure. As shown in FIG. 5, the method includes the following steps.

In S51, whether the current ice-making stage is a heating-deicing stage is detected and determined.

Specifically, whether the refrigerator is in the heating-deicing stage can be determined according to the current operating power of the refrigerator. Referring to the description in step S1, if the current operating power of the refrigerator is between the first power and the second power, it indicates that the current ice-making stage is a heating-deicing stage.

In S52, whether the current temperature is greater than a first preset temperature threshold is detected and determined.

It should be noted that the first preset temperature threshold is preset in the refrigerator, and whether the refrigeration in the refrigerating compartment is initiated can be determined according to the temperature in the ice-making compartment and the first preset temperature threshold. In embodiments of the present disclosure, the first preset temperature threshold is set, and only when the temperature in the ice-making compartment is greater than the first preset temperature threshold, the refrigeration in the refrigerating compartment can be initiated. This allows delaying the refrigeration starting time of the refrigerating compartment, such that the refrigeration cycle of the refrigerating compartment can match the ice-making cycle of the ice-making compartment.

Specifically, the current temperature of the refrigerating compartment of the refrigerator is acquired and then compared with the first preset temperature threshold. Further, the magnitude relationship between the current temperature of the refrigerating compartment of the refrigerator and the first preset temperature threshold can be determined. If the current temperature is greater than the first preset temperature threshold, step S53 is executed; otherwise, step S54 is executed.

In S53, the refrigerating damper is controlled to open and the ice-making damper is controlled to close.

Specifically, when the current temperature is greater than the first preset temperature threshold, the refrigeration of the refrigerating compartment is performed, that is, controlling the refrigerating damper to open, but meanwhile controlling the ice-making damper to close.

S54. Controlling both the ice-making damper and the refrigerating damper to close.

Specifically, if the current temperature is less than or equal to the first preset temperature threshold, both the ice-making damper and the refrigerating damper are closed, that is, the refrigeration system stops refrigerating, thereby delaying the refrigeration starting time of the refrigerating compartment.

Figure 6:
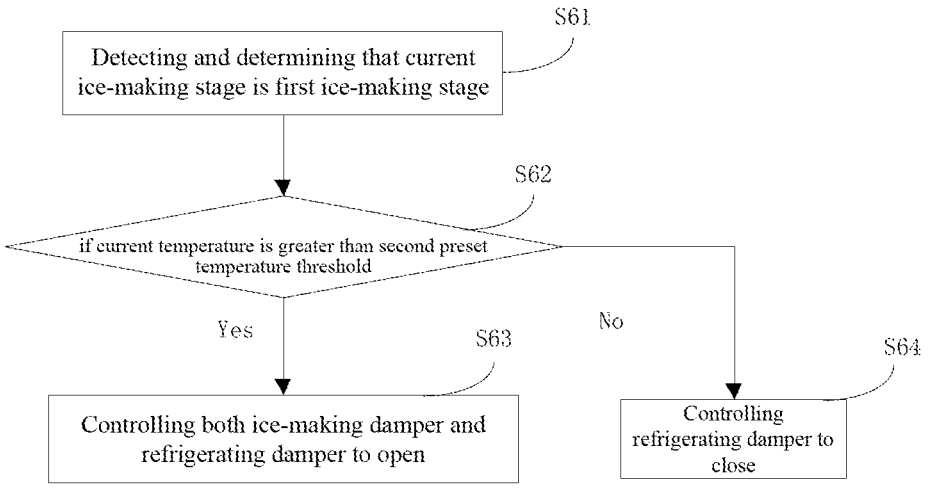
FIG. 6 is a schematic flow chart of a process for improving ice-making efficiency in a method for controlling refrigeration of a refrigerator according to an embodiment of the present disclosure.

In some embodiments, considering that the simultaneous refrigeration of the refrigerating compartment and the refrigerating compartment for a long time would reduce the ice-making efficiency and increase the energy consumption, the refrigeration ending time of the refrigerating compartment can also be controlled to avoid occurrence of the above situation. Specifically, referring to FIG. 6, FIG. 6 is a schematic flow chart of a process for improving ice-making efficiency in the method for controlling refrigeration of a refrigerator according to an embodiment of the present disclosure. As shown in FIG. 6, the method includes the following steps.

In S61, Whether the current ice-making stage is a first ice-making stage is detected and determined.

Specifically, whether the heating-deicing stage ends can be detected. When the heating-deicing stage ends, it indicates that the current ice-making stage is in the first ice-making stage.

In S62, whether the current temperature is greater than a second preset temperature threshold is detected and determined.

It should be noted that the second preset temperature threshold is preset in the refrigerator. Whether the refrigeration in the refrigerating compartment ends can be determined according to the temperature in the ice-making compartment and the second preset temperature threshold. The setting of the second preset temperature threshold prevents the refrigerating compartment and the ice-making compartment from simultaneously refrigerating for a long time, thus not only reducing energy consumption and improving ice-making efficiency, but also meeting the refrigeration requirements of the refrigerating compartment. For example, if the target temperature set in the refrigerating compartment is lower than the second preset temperature threshold, the refrigeration of the refrigerating compartment is ended in advance to ensure ice-making efficiency; and if the target temperature set in the refrigerating compartment is greater than or equal to the second preset temperature threshold, the refrigeration of the refrigerating compartment can be ended when the target temperature is reached.

Specifically, the current temperature of the refrigerating compartment of the refrigerator is acquired and then compared with the second preset temperature threshold. Further, the magnitude relationship between the current temperature of the refrigerating compartment of the refrigerator and the second preset temperature threshold is determined. If the current temperature is greater than the second preset temperature threshold, step S63 is executed; otherwise, step S64 is executed.

In S63, both the ice-making damper and the refrigerating damper are controlled to open.

Specifically, if the current temperature is greater than the second preset temperature threshold, both the ice-making damper and the refrigerating damper are opened, thus performing the refrigeration in both of the ice-making compartment and the refrigerating compartment.

In S64, the refrigerating damper is controlled to close.

Specifically, if the current temperature is less than or equal to the second preset temperature threshold, the refrigerating damper is controlled to close, thus ending the refrigeration in the refrigerating compartment.

It should be understood that, in this embodiment, the method needs to acquire a refrigeration request instruction issued by at least one of the refrigerating compartment and the ice-making compartment before controlling the opening and closing of the ice-making damper and the refrigerating damper, and perform the opening and closing of the ice-making damper and the refrigerating damper according to the corresponding refrigeration request instruction.

Figure 7:
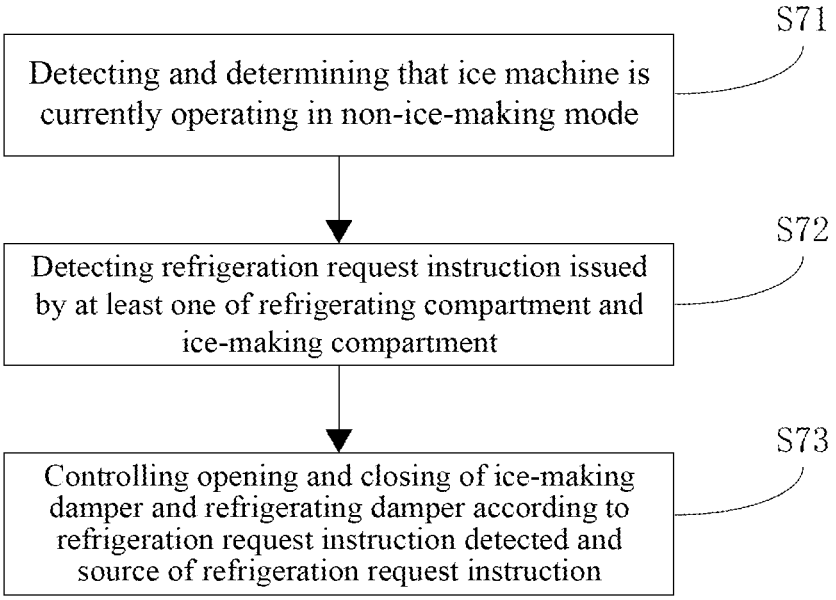
FIG. 7 is a schematic flow chart of a method for controlling refrigeration of a refrigerator according to an embodiment of the present disclosure.

In some embodiments, if the ice machine is currently operating in a non-ice-making mode, the opening and closing of the ice-making damper and the refrigerating damper can be controlled according to the following steps. As shown in FIG. 7, the method includes steps.

In S71, whether the ice machine is currently operating in a non-ice-making mode is detected and determined.

Specifically, referring to the description in step S1 as described above, if the ice machine is not in the ice-making mode, it is determined that the ice machine is currently operating in a non-ice-making mode.

In S72, whether a refrigeration request instruction issued by at least one of the refrigerating compartment and the ice-making compartment is detected.

Specifically, during the operation of the refrigerator, when the internal temperature of the refrigerator changes, compartments like the refrigerating compartment, the ice-making compartment and the like are to be refrigerated from time to time. When a corresponding compartment needs to be refrigerated, the corresponding compartment will issue a refrigeration request instruction to request the refrigeration by the refrigerator. Thus, the refrigeration request instruction issued by respective compartment can be detected in real time or at intervals.

In S73, the opening and closing of the ice-making damper and the refrigerating damper are controlled according to the refrigeration request instruction detected and a source of the refrigeration request instruction.

Specifically, the opening and closing of the ice-making damper and the refrigerating damper are controlled according to the refrigeration request instruction issued by corresponding compartments. For example, if the ice-making compartment and the refrigerating compartment both issue a refrigeration request instruction, the ice-making damper and the refrigerating damper are both opened. If the ice-making compartment issues a refrigeration request instruction but the refrigerating compartment does not issue a refrigeration request instruction, the ice-making damper is opened but the refrigerating damper is closed.

Figure 8:
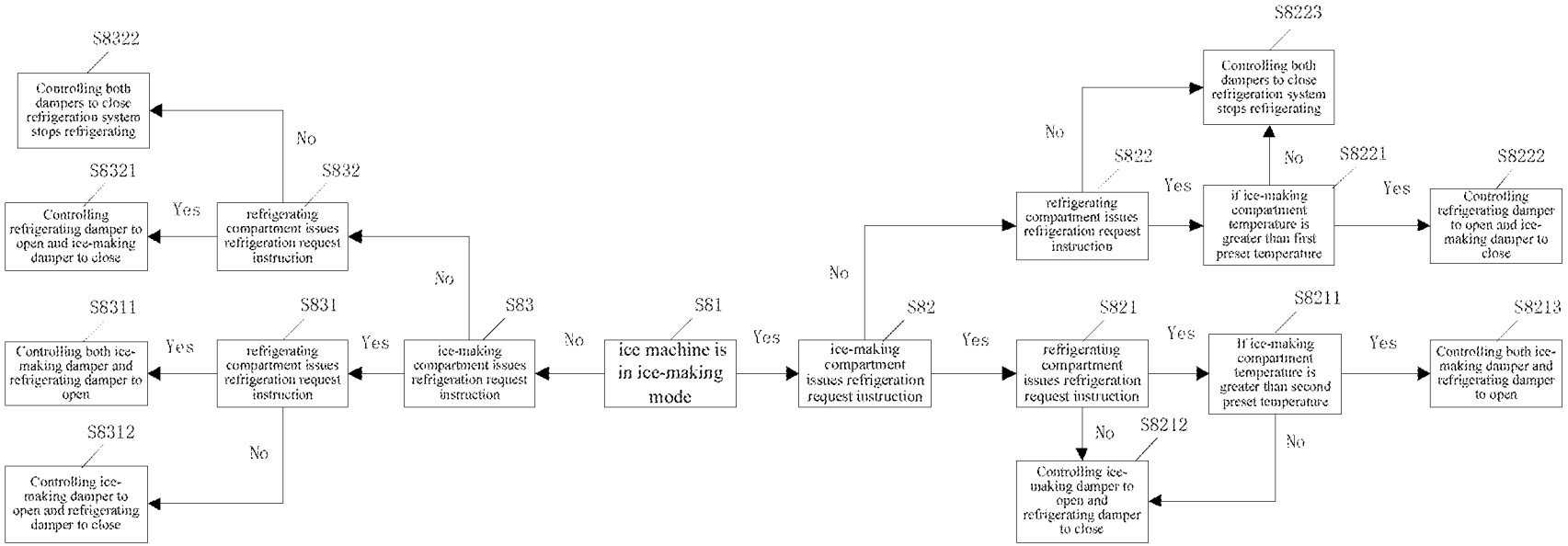
FIG. 8 is a flow chart of a process for controlling a method for controlling refrigeration of a refrigerator according to an embodiment of the present disclosure.

FIG. 8 is a flow chart of a process for controlling the method for controlling refrigeration of a refrigerator according to an embodiment of the present disclosure. As shown in FIG. 8, the process for controlling a method for controlling refrigeration of a refrigerator according to an embodiment of the present disclosure includes the following steps.

In S81, whether the ice machine is in an ice-making mode is detected.

If yes, a step S82 is executed. If no, a step S83 is executed.

In S82, whether the ice-making compartment issues a refrigeration request instruction is detected.

If yes, a step S821 is executed. If no, a step S822 is executed.

In S821, whether the refrigerating compartment issues a refrigeration request instruction is detected.

If yes, a step S8211 is executed. If no, a step S8212 is executed.

In S8211, whether the current temperature of the ice-making compartment is greater than a second preset temperature threshold is detected.

If yes, a step S8213 is executed. If no, a step 8212 is executed.

In S8212, the ice-making damper is controlled to open and the refrigerating damper is controlled to close.

In S8213, both the ice-making damper and the refrigerating damper are controlled to open.

In S822, whether the refrigerating compartment issues a refrigeration request instruction is detected.

If yes, a step S8221 is executed. If no, a step S8222 is executed.

In S8221, whether the current temperature of the ice-making compartment is greater than a first preset temperature threshold is detected.

If yes, a step S8222 is executed. If no, a step S8223 is executed.

In S8222, the refrigerating damper is controlled to open and the ice-making damper is controlled to close.

In S8223, both the ice-making damper and the refrigerating damper are controlled to close, and the refrigeration system stops refrigerating.

In S83, whether the ice-making compartment issues a refrigeration request instruction is detected.

If yes, a step S831 is executed. If no, a step S832 is executed.

In S831, whether the refrigerating compartment issues a refrigeration request instruction is detected.

If yes, a step S8311 is executed. If no, a step S8312 is executed.

In S8311, both the ice-making damper and the refrigerating damper are controlled to open.

In S8312, the ice-making damper is controlled to open and the refrigerating damper is controlled to close.

In S832, whether the refrigerating compartment issues a refrigeration request instruction is detected.

If yes, a step S8321 is executed. If no, a step S8322 is executed.

In S8321, the refrigerating damper is controlled to open and the ice-making damper is to close.

In S8322, both the ice-making damper and the refrigerating damper are controlled to close, and the refrigeration system stops refrigerating.

It should be noted that, according to the method provided in this embodiment, the refrigeration system of the refrigerator is controlled, such that the refrigeration cycle of the refrigerating compartment matches the ice-making cycle of the ice-making compartment, as shown in the schematic diagram of the refrigeration cycle of refrigerating compartment and the ice-making cycle of ice-making compartment in FIG. 4. Therefore, the ice-making in the ice machine is less influenced by the refrigeration in the refrigerating compartment, thus improving the ice-making efficiency and ice-making amount, shortening the ice-making cycle, and reducing the energy consumption of the refrigerator.

Figure 9:
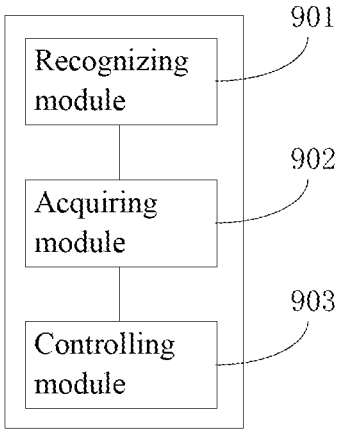
FIG. 9 is a block diagram showing the structure of a device for controlling refrigeration of a refrigerator according to an embodiment of the present disclosure.

To implement the method in the foregoing embodiments, the present disclosure still further provides a device for controlling refrigeration of a refrigerator, in which a refrigeration system of the refrigerator includes an evaporator, an ice-making damper and a refrigerating damper. The evaporator is configured to refrigerate the refrigerating compartment and make an ice in the ice machine. FIG. 9 is a block diagram showing the structure of a device for controlling refrigeration of a refrigerator according to an embodiment of the present disclosure. As shown in FIG. 9, the device includes:

- a recognizing module 901, configured to recognize a current ice-making stage of the ice machine;
- an acquiring module 902, configured to acquire a current temperature of the ice-making compartment in the refrigerator; and
- a controlling module 903, configured to control opening and closing of the ice-making damper and the refrigerating damper according to the current ice-making stage and the current temperature.

Further, the controlling module 903 is further configured to:

- detect and determine that the current ice-making stage is a heating-deicing stage;
- detect and determine that the current temperature is greater than a first preset temperature threshold; and
- control the refrigerating damper to open and control the ice-making damper to close.

Further, the controlling module 903 is further configured to:

detect and determine that the current temperature is less than or equal to the first preset temperature threshold; and control both the ice-making damper and the refrigerating damper to close.

Further, the controlling module 903 is further configured to:

acquire a current operating power of the refrigerator;

detect and determine that the current operating power is within a preset range; and determine that the current ice-making stage is the heating-deicing stage.

Further, the controlling module 903 is further configured to:

detect and determine that the current ice-making stage is a first ice-making stage;

detect and determine that the current temperature is greater than a second preset temperature threshold; and control both the ice-making damper and the refrigerating damper to open.

Further, the controlling module 903 is further configured to:

detect and determine that the current temperature is less than or equal to the second preset temperature threshold; and control the refrigerating damper to close.

Further, the controlling module 903 is further configured to:

acquire a refrigeration request instruction issued by at least one of the refrigerating compartment and the ice-making compartment.

Further, the controlling module 1003 is further configured to:

detect and determine that the ice machine is currently operating in an ice-making mode before recognizing the current ice-making stage of the ice machine.

Further, the controlling module 903 is further configured to:

detect and determine that the ice machine is currently operating in a non-ice making mode;

detect a refrigeration request instruction issued by at least one of the refrigerating compartment and the ice-making compartment; and control the opening and closing of the ice-making damper and the refrigerating damper according to the refrigeration request instruction detected and a source of the refrigeration request instruction.

It should be understood that the foregoing device is configured to execute the method described in the foregoing embodiments. The corresponding program module in the device has implementation principles and technical effects which are similar to those described in the foregoing method. The working process of the device may take reference to the process of the corresponding method as above, which will not be repeated herein.

According to the device for controlling refrigeration of a refrigerator provided in the embodiments of the present disclosure, the controlling module in the device controls a connecting direction of the control valve in the refrigeration system of the refrigerator according to the current ice-making stage of the ice machine recognized by the recognizing module and the current temperature of the ice-making compartment acquired by the acquiring module. Further, the opening and closing of the ice-making damper and the refrigerating damper are controlled to determine the time for performing refrigeration and the time for ending refrigeration for corresponding compartments, and thus controlling the refrigeration period of the refrigerating compartment, delaying the refrigeration starting time of the refrigerating compartment, and setting the refrigeration starting time of the refrigerating compartment to be within a heating-deicing stage of ice-making mode of the ice-making compartment, such that the refrigeration cycle of the refrigerating compartment matches the ice-making cycle of the ice-making compartment, thus improving the ice-making efficiency of the ice machine, and reducing the energy consumption of the refrigerator.

Figure 10:
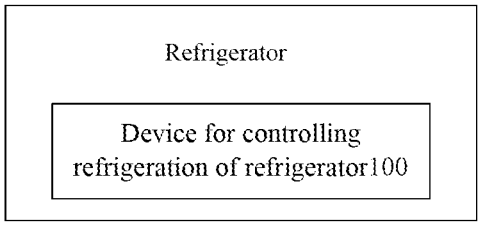
FIG. 10 is a block diagram showing the structure of a refrigerator according to an embodiment of the present disclosure.

To implement the above embodiments, the present disclosure still further provides a refrigerator. FIG. 10 is a block diagram showing the structure of a refrigerator according to an embodiment of the present disclosure. As shown in FIG. 10, the refrigerator includes the device for controlling refrigeration of a refrigerator 100.

Figure 11:
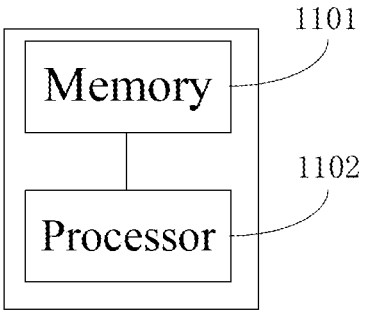
FIG. 11 is a block diagram showing the structure of an electronic device according to an embodiment of the present disclosure.

To implement the above embodiments, the present disclosure still further provides an electronic device. FIG. 11 is a block diagram showing the structure of an electronic device according to an embodiment of the present disclosure. As shown in FIG. 11, the electronic device includes a memory 1101 and a processor 1102. The processor 1102 runs a program corresponding to an executable program code by reading the executable program code stored in the memory 1101, to be configured to implement each step in the method described above.

To implement the embodiments as mentioned above, the present disclosure still further provides a non-transitory computer-readable storage medium having stored therein computer programs that, when executed by a processor, causes the processor to implement each step in the method described above.

In the description of the present disclosure, it should be understood that the terms "center," "longitudinal," "transverse," "length," "width," "thickness," "upper," "lower," "front," "back," "left," "right," "vertical," "horizontal," "top," "bottom," "inner," "outer," "clockwise," "counter-clockwise," "axial," "radial," "circumferential" and the like indicate the orientation or positional relationship is that shown in the drawings, and is only for the convenience of describing the present disclosure and simplifying the description, rather than indicating or implying the pointed device or element has to have a specific orientation, and be constructed and operated in a specific orientation, and therefore cannot be understood as a limitation of the present disclosure.

In addition, the terms "first" and "second" are only used for descriptive purposes and cannot be understood as indicating or implying relative importance or implicitly indicating the number of indicated technical features. Therefore, the features defined with "first" and "second" may explicitly or implicitly include at least one of the features. In the description of the present disclosure, the "plurality" means two or more than two, unless otherwise specifically defined.

In the present disclosure, the terms "disposed," "arranged," "connected," "fixed" and the like should be understood broadly and may be either a fixed connection or a detachable connection, or an integration; may be a mechanical connection, or an electrical connection; may be directly connected, or connected via an intermediate medium; and may be the internal communication of two elements or the interaction of two elements, unless otherwise explicitly stated and defined. For those skilled in the art, the specific meanings of the above terms in the present disclosure can be understood according to specific situations.

In the present disclosure, a first feature "on" or "under" a second feature may refer to a direct contact of the first feature with the second feature or an indirect contact of the first feature and the second feature via an intermediate medium, unless otherwise explicitly stated and defined. Moreover, a first feature "above" a second feature may mean the first feature is right above or obliquely above the second feature, or merely that the first feature is located at a level higher than the second feature. A first feature "below" a second feature may mean the first feature is just below or obliquely below the second feature, or merely that the first feature is located at a level lower than the second feature.

Reference throughout this specification to "an embodiment," "one embodiment," "some embodiments," "an example," "a specific example" or "some examples" means that a particular feature, structure, material, or characteristic described in connection with the embodiment or example is included in at least one embodiment or example of the present disclosure. Thus, the appearances of the phrases such as "in some embodiments," "in one embodiment," "in an embodiment," "in an example," "in a specific example" or "in some examples" in various places throughout this specification are not necessarily referring to the same embodiment or example of the present disclosure. Moreover, the described particular feature, structure, material, or characteristic may be combined in any one or more embodiments or examples in a suitable manner. Furthermore, the different embodiments or examples and the features of the different embodiments or examples described in this specification may be combined by those skilled in the art without contradiction.

Although embodiments of the present disclosure have been shown and described in the above, it would be appreciated that the above embodiments are exemplary which cannot be construed to limit the present disclosure, and changes, alternatives, substitution and modifications can be made in the embodiments by those skilled in the art without departing from scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A method for controlling refrigeration of a refrigerator using a refrigeration system, comprising:

recognizing a current ice-making stage of an ice machine;

acquiring a current temperature of an ice-making compartment in the refrigerator; and controlling opening or closing of an ice-making damper and a refrigerating damper according to the current ice-making stage and the current temperature, wherein the refrigeration system comprises an evaporator, the ice-making damper, and the refrigerating damper, the evaporator configured to refrigerate a refrigerating compartment and make ice in the ice machine, wherein controlling opening or closing of the ice-making damper and the refrigerating damper according to the current ice-making stage and the current temperature includes:

determining whether the current ice-making stage is a heating-deicing, stage;

determining whether the current temperature is greater than a first preset temperature threshold; and controlling the refrigerating damper to open and controlling the ice-making damper to dose in response to determining that the current ice-making stage is the heating-deicing stage and the current temperature is greater than the first preset temperature threshold.

2. The method according to claim 1, further comprising controlling both the ice-making damper and the refrigerating damper to close in response to the current ice-making stage being the heating-deicing stage and the current temperature being no greater than the first preset temperature threshold.

3. The method according to claim 1, wherein determining whether the current ice-making stage is a heating-deicing stage comprises:

acquiring a current operating power of the refrigerator;

determining whether the current operating power is within a preset range; and determining whether the current ice-making stage is the heating-deicing stage.

4. The method according to claim 1, further comprising:

determining whether the current ice-making stage is a first ice-making stage;

determining whether the current temperature is greater than a second preset temperature threshold; and controlling both the ice-making damper and the refrigerating damper to open in response to determining that the current ice-making stage is the first, ice-making stage and the current temperature is greater than a second preset temperature threshold.

5. The method according to claim 4, further comprising: controlling the refrigerating damper to close in response to the current ice-making stage being the first ice-making stage and the current temperature being no greater than the second preset temperature threshold.

6. The method according to claim 1, further comprising:

acquiring a refrigeration request instruction issued by at least one of the refrigerating compartment and the ice-making compartment, before controlling the opening or closing of the ice-making damper and the refrigerating damper according to the current ice-making stage and the current temperature.

7. The method according to claim 1, further comprising:

determining whether the ice machine is currently operating in an ice-making mode, before recognizing the current ice-making stage of the ice machine.

8. The method according to claim 1, further comprising:

determining whether the ice machine is currently operating in a non-ice making mode;

detecting a refrigeration request instruction issued by at least one of the refrigerating compartment or the ice-making compartment; and controlling the opening or closing of the ice-making damper and the refrigerating damper according to the refrigeration request instruction detected and the at least one of the refrigerating compartment or the ice-making compartment as a source of the refrigeration request instruction in response to determining that the ice machine is currently operating in the non-ice making mode.

9. An electronic device, comprising:

a memory; and a processor, wherein the processor runs a program corresponding to an executable program code by reading the executable program code stored in the memory, to be configured to implement the method for controlling refrigeration of a refrigerator of claim 1.

10. A non-transitory computer-readable storage medium having stored therein computer programs that, when executed by a processor, causes the processor to perform the method for controlling refrigeration of a refrigerator of claim 1.

11. A device for controlling refrigeration of a refrigerator using a refrigeration system, comprising:

a recognizing module, configured to recognize a current ice-making stage of an ice machine;

an acquiring module, configured to acquire a current temperature of an ice-making compartment in the refrigerator; and a controlling module, configured to control opening or closing of an ice-making damper and a refrigerating damper according to the current ice-making stage and the current temperature, wherein the refrigeration system comprises an evaporator, the ice-making damper, and the refrigerating damper, the evaporator configured to refrigerate a refrigerating compartment and make ice in the ice machine, wherein the controlling opening or closing of the ice-making damper and the refrigerating damper according to the current ice-making stage and the current temperature includes:

determining whether the current ice-making stage is a first ice-making stage;

determining whether the current temperature is greater than a first preset temperature threshold;

controlling both the ice-making damper and the refrigerating damper to open in response to determining that the current ice-making stage is the first ice-making stage and the current temperature is greater than the first preset temperature threshold; and controlling the refrigerating damper to dose in response to determining that the current ice-making stage is the first ice-making stage and the current temperature is no greater than the first preset temperature threshold.

12. The device according to claim 11, wherein the controlling module is further configured to:

determine whether the current ice-making stage is a heating-deicing stage;

determine whether the current temperature is greater than a second preset temperature threshold; and control the refrigerating damper to open and control the ice-making damper to close in response to determining that the current ice-making stage is the heating-deicing stage and the current temperature is greater than the second preset temperature threshold.

13. The device according to claim 12, wherein the controlling module is further configured to:

control both the ice-making damper and the refrigerating damper to close in response to the current ice-making stage being the heating-deicing stage and the current temperature being no greater than the second preset temperature threshold.

14. The device according to claim 12, wherein the controlling module is further configured to:

acquire a current operating power of the refrigerator;

determine that the current operating power is within a preset range; and determine that the current ice-making stage is the heating-deicing stage.

15. The device according to claim 11, wherein the controlling module is further configured to:

acquire a refrigeration request instruction issued by at least one of the refrigerating compartment and the ice-making compartment.

16. The device according to claim 11, wherein the controlling module is further configured to:

determine whether the ice machine is currently operating in an ice-making mode before recognizing the current ice-making stage of the ice machine.

17. The device according to claim 11, wherein the controlling module is further configured to:

determine whether the ice machine is currently operating in a non-ice making mode;

detect a refrigeration request instruction issued by at least one of the refrigerating compartment or the ice-making compartment; and control the opening or closing of the ice-making damper and the refrigerating damper according to the refrigeration request instruction detected and the at least one of the refrigerating compartment or the ice-making compartment as a source of the refrigeration request instruction in response to determining that the ice machine is currently operating in the non-ice making mode.

18. A refrigerator, comprising the device for controlling refrigeration of a refrigerator of claim 11.

* * * * *